US007757830B2

(12) United States Patent
Boffelli

(10) Patent No.: US 7,757,830 B2
(45) Date of Patent: Jul. 20, 2010

(54) DUAL ARMATURE DEVICE FOR TRANSMITTING THE MOVEMENT TO FANS FOR COOLING THE ENGINE OF MOTOR VEHICLES

(75) Inventor: Piercarlo Boffelli, Milan (IT)

(73) Assignee: Baruffaldi S.p.A., Tribano (MI) (IT)

( * ) Notice: Subject to any disclaimer, the term of this patent is extended or adjusted under 35 U.S.C. 154(b) by 720 days.

(21) Appl. No.: 11/538,826

(22) Filed: Oct. 5, 2006

(65) Prior Publication Data

US 2007/0084691 A1 Apr. 19, 2007

(51) Int. Cl.
*F16D 27/04* (2006.01)

(52) U.S. Cl. ..... 192/48.2; 192/84.21; 192/84.961

(58) Field of Classification Search ..... 192/48.2, 192/84.21, 84.961
See application file for complete search history.

(56) References Cited

U.S. PATENT DOCUMENTS 5,636,719 A * 6/1997 Davis et al. ..... 192/18 A
6,013,003 A * 1/2000 Boffelli et al. ..... 475/149
6,598,720 B2 * 7/2003 Ritter et al. ..... 192/48.2
6,915,887 B2 * 7/2005 Faller et al. ..... 192/48.2

FOREIGN PATENT DOCUMENTS

| | | |
|---|---|---|
| EP | 0 317 703 A2 | 5/1989 |
| EP | 07-293594 | 11/1995 |
| EP | 1 002 940 A2 | 5/2000 |
| JP | 101 58 732 A1 | 6/2003 |

* cited by examiner

*Primary Examiner*—Ha D. Ho
(74) *Attorney, Agent, or Firm*—Mintz Levin Cohn Ferris Glovsky and Popeo, P.C.

(57) ABSTRACT

A multi-speed drive for a motor cooling fan mounted on a driveshaft has provided a first electromagnetic clutch containing one electromagnet, and first and second armatures. When no current is imposed on the electromagnet, the clutch does not engage and the fan remains stationary with respect to the rotating driveshaft. Depending on the amount of current imposed on the electromagnet, the fan will either rotate at a speed slower than the drive shaft or, when maximum current is imposed, the fan will be rotated at the same speed as the rotating driveshaft.

10 Claims, 2 Drawing Sheets

DUAL ARMATURE DEVICE FOR TRANSMITTING THE MOVEMENT TO FANS FOR COOLING THE ENGINE OF MOTOR VEHICLES

CROSS REFERENCE TO RELATED APPLICATIONS

Italian Patent Application No. M12005A 001423 which is hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a dual armature device for transmitting the movement to fans for cooling the coolant in motor vehicles and for coupling and decoupling an actuator to the fans for controlling the speed of the fans.

2. Description of Related Art

It is known in the technical sector relating to the cooling of coolants contained in motor-vehicle radiators that there exists the need to force air onto the radiator in order to obtain more rapid dissipation of heat from the coolant to the exterior, said forced air flow being obtained by causing rotation of a fan which is normally mounted on the shaft of the water pump or on the driving shaft or on a driven and fixed shaft carrying a pulley which receives movement from a belt actuated by the driving shaft.

It is also known that said fan must be made to rotate only upon reaching a certain predefined temperature of the water detected by means of a thermostat which activates an electromagnetic clutch, closing of which causes the fan to start rotating.

More particularly it is required that a motor vehicle fan must be able to rotate:

- at a lower speed than that of the transmission shaft for cooling in low external temperature conditions;
- at a speed equal to or even greater than that of the transmission shaft in the case of higher external temperatures or use in severe conditions which cause overheating of the engine;
- at zero speed, namely with the fan which does not rotate at all and remains in an idle condition with respect to the transmission shaft, in the case of particularly low temperatures at which further cooling is of no use or even damaging.

In an attempt to achieve these performance features, coupling systems of the mixed type with electromagnetically operated friction clutches and drive couplings based on the use of parasitic currents generated by rotation of a conducting element in the vicinity of permanent magnets have been developed.

DE-32 03 143 describes, for example, an arrangement in which the driving shaft is connected to the rotor of an electromagnetic clutch, which is engaged by an armature connected to the fan for direct driving, whereas low speed conditions make use of the engagement between a conducting disk, rotating with the transmission shaft, and the permanent magnets integral with the fan, said engagement causing transmission of movement at a low speed as a result of relative slipping between the two parts. With this solution, however, it is not possible to obtain the idle condition of the fan.

In addition, the known devices do not envisage the possibility of maintaining an albeit slow rotation of the fan (fail safe mode) in the event of breakage and/or complete interruption of the power supply to the coils of the clutches as occurs for example in the case of total electrical failure.

BRIEF SUMMARY OF THE INVENTION

The technical problem which is posed, therefore, is that of providing a device for transmitting the rotational movement to a fan for cooling the coolant of motor vehicles, which allows the fan to rotate at a number of revolutions which is different from that of the driving shaft and can be determined depending on the actual cooling requirement of the engine, which device has compact dimensions and does not have large and costly projecting rotational masses and is formed by a limited number of costly parts.

In connection with this problem it is also convenient that the device should be able to keep the fan stationary in an idle position and also ensure reliable rotation of the fan also in the event of malfunction of the associated power supply and control devices.

These technical problems are solved according to the present invention by a device for transmitting the movement to a fan cooling the coolant of a motor vehicle, according to the characteristic features of the present invention.

The invention is directed to a device for controlling and transmitting movement to a fan for cooling the coolant in a motor vehicle. The device can include support element on which the fan can be rotatably mounted by means of an idle bell member, a first electromagnetic clutch comprising at least one first electromagnet and a rotor. The device can further include a first armature connected to the idle bell member by means of a second clutch and a second armature directly connected to the idle bell member supporting the fan. Wherein, when the first clutch is energized to a first level, the first armature engages the rotor and rotates the second clutch which causes the fan to rotate at a first speed and when the first clutch is energized to a second level, the second armature engages the rotor and rotates the fan at a second speed. The second clutch can be a Foucault parasitic current type clutch.

The support element can be fixed in place and the idle bell member, the second clutch and the rotor can be rotatably mounted to the support element, such as by one or more bearings. The first electromagnet can be stationary and coupled to the engine of the motor vehicle. The second armature can be coupled to the idle bell member or the support for the fan by a resilient bearing that can absorb the torsion vibration during the actuation of the second armature. The first clutch can include a second electromagnet for actuating the first armature.

The first clutch can also include a permanent magnet which can be configured to operate as failsafe. Under normal conditions, energizing the second electromagnet can operate to neutralize the permanent magnet and actuate the first armature to drive the second clutch and the fan at a first speed. In the event of a power failure, the permanent magnets can be strong enough to actuate the first armature in order drive the fan at a slow speed.

BRIEF DESCRIPTION OF THE SEVERAL VIEWS OF THE DRAWINGS

Further details may be obtained from the following description of a non-limiting example of embodiment of the invention, provided with reference to the accompanying drawings in which.

DETAILED DESCRIPTION OF THE INVENTION

Figure 1:
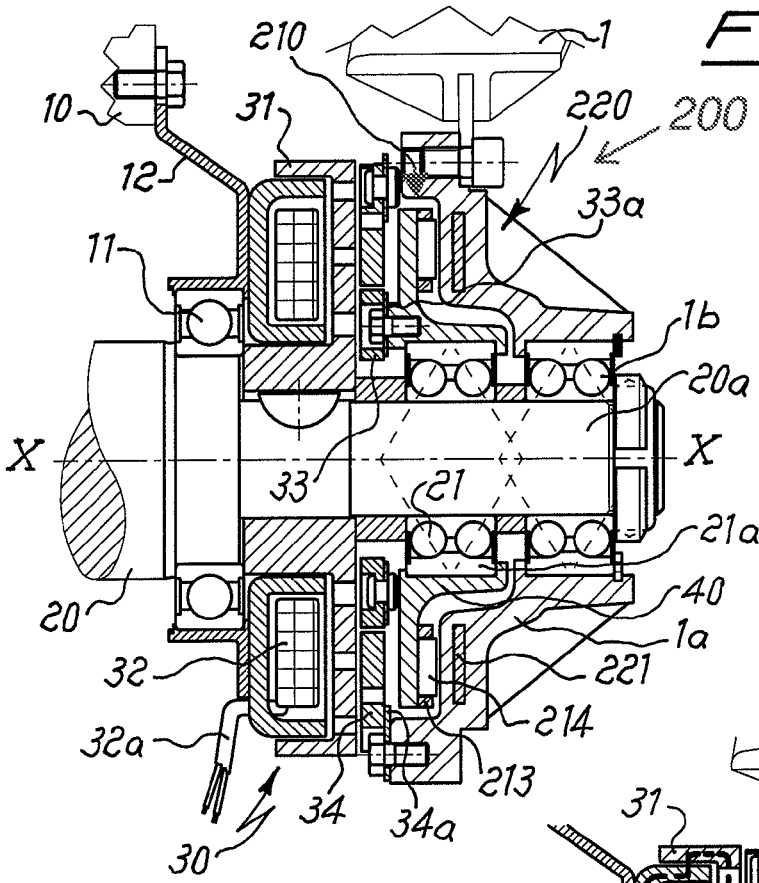
FIG. 1 shows a schematic axial cross-section through a first embodiment of the device for transmitting the movement to the fan according to the present invention in the idle condition.

As shown in FIG. 1, the cooling fan 1 is fastened to a supporting idle bell member 1*a* arranged on a bearing 1*b* mounted on a support element, an extension 20*a* of the driving shaft 20 of the vehicle, so as to be coaxial with the axis of rotation thereof.

For the sake of convenience of the description below, "longitudinal direction X-X" will be understood as meaning that direction coinciding with/parallel to the longitudinal axis of the driving shaft.

The same extension 20*a* of the shaft 20 also has mounted thereon, locked rotationally therewith, a rotor 31 which forms the rotating element of a first clutch 30 comprising an annular electromagnet 32 concentric with the rotor 31 and mounted on the outer race of a bearing 11 arranged between the rotating shaft and a fixed support flange 12 joined to the base 10 of the engine; the electromagnet 32 is electrically connected by means of wires 32*a* to a thermostat (not shown) for example for the temperature of the cooling fluid.

A first armature 33 is arranged on the opposite side to the electromagnet 32 with respect to the rotor 31 and is connected to an annular flange 40 joined to the outer race 21*a* of a bearing 21 in turn keyed or otherwise fixed onto the shaft 20.

The connection between armature 33 and flange 40 is effected with the arrangement, in between, of a resilient member 33*a* able to allow axial movements of the armature 33, but prevent relative rotation of the armature and flange 40.

Said flange 40 also supports the first part 210 of a second clutch 200, the other part 220 of which is integral with the idle bell member 1*a* of the fan 1.

In greater detail, said first part 210 of the clutch comprises a retaining ring 213 which is made of non-magnetic material and which carries permanent magnets 214.

The second clutch part 220 is formed by a ring 221 which is made of conductive material and integral with the idle bell member 1*a* which is made of non-magnetic material such as, for example, die-cast aluminum.

With this configuration, the first part 210 of the second clutch 200 forms the rotor part for generating the movement of the said clutch 200 which, by means of the flange 40 and the permanent magnets 214, causes the generation of Foucault currents resulting in induction linkage with the driven disk 211 which is rotationally driven, causing rotation of the idle bell member 1*a* and therefore the fan 1.

A second armature 34 is arranged concentrically with the first armature 33, being arranged radially further outwards with respect to the first armature and being connected to the idle bell member 1*a* by means of a resilient membrane 34*a* connected to the idle bell member 1*a* with the arrangement, in between, of a resilient member 34*a* able to allow axial movements of the armature 34, but prevent relative rotation of the armature and idle bell member.

The membrane 34*a* of the second armature 34 has a resistance in the axial direction greater than that of the membrane 33*a* of the first armature, therefore requiring a greater actuation force in order to allow displacement of the armature towards the rotor 31.

The second armature 34 also has radial dimensions much greater than those of the first armature 33.

Figure 2:
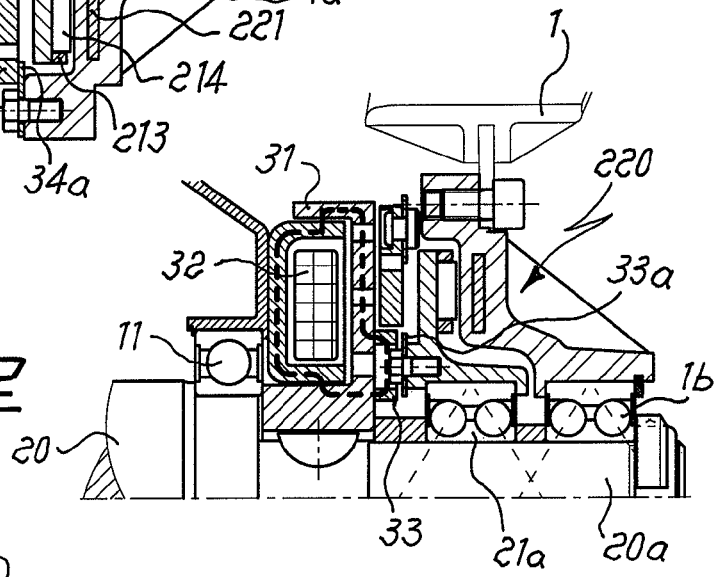
FIG. 2 shows an axial cross-section similar to that of FIG. 1 in the slow travel condition.
Figure 3:
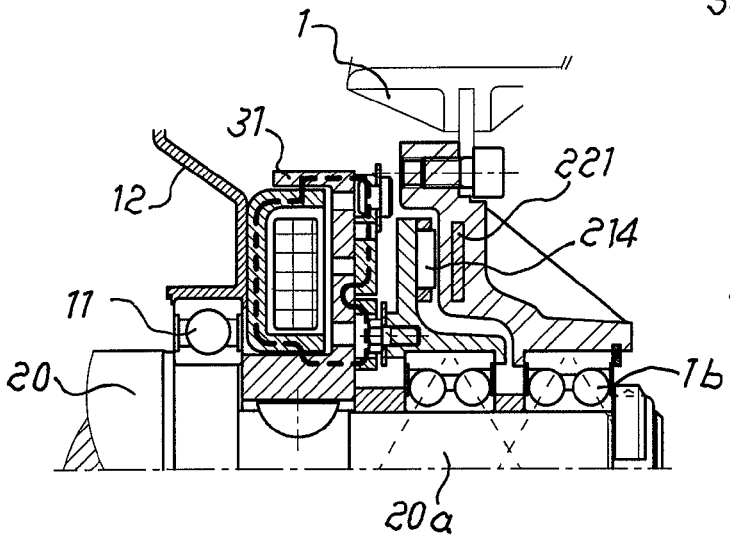
FIG. 3 shows an axial cross-section similar to that of FIG. 1 in the fast travel condition.

With this configuration it is possible to obtain the different and required speeds of rotation of the fan 1, i.e.:

a) in conditions where the electromagnet 32 is not excited (FIG. 1) and the clutch 30 therefore disengaged, the movement of the driving shaft 20 is not transmitted to the fan 1 which remains stationary in the idle condition;

b) in conditions where the electromagnet 32 is excited with a small amount of current (FIG. 2), only the first smaller-size armature 33 is actuated and, overcoming the limited resistance in the axial direction of the membrane 33*a*, engages with the rotor 31 and transmits the movement to the fan via the Foucault coupling 200; since transmission occurs with relative slipping of the flange 40 and the idle bell member 1*a*, the latter rotates at a slower speed than that of the driving shaft 20;

c) in conditions where the electromagnet 32 is excited with maximum current (FIG. 3), the second armature 34 is also actuated and, overcoming the resistance of the associated membrane 34*a*, engages with the rotor 31, transmitting the movement of the driving shaft 20 directly to the idle bell member 1*a* and resulting in a speed of rotation of the fan equal to the speed of rotation of the driving shaft.

Figure 4:
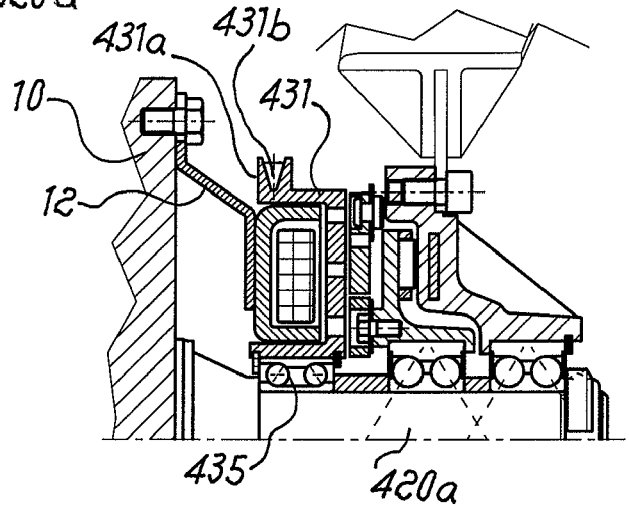
FIG. 4 shows a schematic axial cross-section through a second embodiment of the device according to the present invention.

FIG. 4 shows a first example of a variation of embodiment of the device according to the invention in which the entire assembly is mounted on a fixed shaft 420*a* and the rotor 431 is mounted on the fixed shaft with a bearing 435 arranged in between; the rotor has an annular extension in the form of a pulley 431*a* able to engage with a corresponding drive belt 431*b* by means of which it actuates the said rotor 431.

Figure 5:
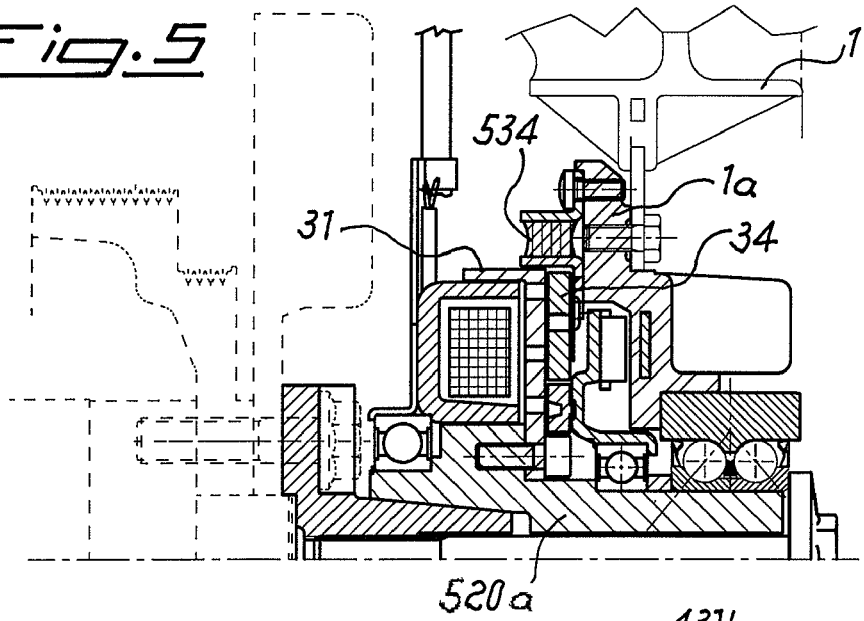
FIG. 5 shows a schematic axial cross-section through a third embodiment of the device according to the present invention.

FIG. 5 shows a further embodiment of the device in which the rotor 31 is connected to an extension 520*a* of the driving shaft and the second armature 34 is joined to the support 1*a* of the fan via a resilient bearing 534 able to absorb the torsional vibrations during engagement.

It can therefore be seen how, with the dual armature device according to the invention, it is possible to obtain the required multiple-speed and idle operation with compact axial and radial dimensions and a small number of parts, also avoiding the use of special bearings with a consequent reduction in the associated production, assembly and maintenance costs.

What is claimed is:

1. Device for controlling the movement of a fan for cooling the coolant in a motor vehicle, comprising:

a support element on which the fan is mounted by an idle bell member;

a first electromagnetic clutch having an electromagnet, a rotor and a first armature connected to the idle bell member by a second clutch of the Foucault parasitic current type;

a second armature concentric to the first armature, controlled by the electromagnet and directly connected to said bell member supporting the fan, wherein the second clutch is interposed between the rotor and the bell member;

wherein the first armature and second armatures are respectively connected to an anchor flange and to the bell member supporting the fan by a respective first and second resilient membrane; and wherein the resilient membrane of the first armature has a resistance in the axial direction less than the axial resistance of the second membrane of the second armature.

2. Device according to claim 1, wherein said support element is an extension of a driving shaft of the vehicle and the rotor is rotationally locked to the support element.

3. Device according to claim 1, wherein the electromagnet is mounted to the race of a bearing arranged between the support element and a fixed flange joined to an engine of the motor vehicle.

4. Device according to claim 1, wherein said second armature has radial dimensions greater than those of the first armature.

5. Device according to claim 1, wherein said second clutch includes a first part integral with a flange connected to the first armature and a second part integral with the idle bell member.

6. Device according to claim 5, wherein said first part of the second clutch includes a first ring made of non-magnetic material, said first ring containing permanent magnets.

7. Device according to claim 5, wherein said second part of the second clutch includes a second ring made of conductive material, said second ring being integral with the idle bell member and said idle bell member being made of non-magnetic material.

8. Device according to claim 1, wherein said support element is fixed.

9. Device according to claim 8, wherein the rotor is mounted for rotation on the support element by a bearing.

10. Device according to claim 9, wherein said rotor includes a pulley adapted for engaging a drive belt.

* * * * *